US005237315A

United States Patent [19]

Gay et al.

[11] Patent Number: 5,237,315

[45] Date of Patent: Aug. 17, 1993

[54] METHOD FOR ADJUSTING THE LUMINOSITY OF DISPLAY SCREENS

[75] Inventors: Michel Gay, Le Fontanil; Jacques Deschamps, Grenoble; Serge Salavin, St Egreve; Michel Specty, Echirolles, all of France

[73] Assignee: Thomson Tubes Electroniques, Boulogne-Billancourt, France

[21] Appl. No.: 691,781

[22] Filed: Apr. 26, 1991

[30] Foreign Application Priority Data

May 15, 1990 [FR] France ..... 90 06033

[51] Int. Cl.[5] ..... G09G 3/00

[52] U.S. Cl. ..... 340/789; 340/805; 315/169.4

[58] Field of Search ..... 340/789, 758, 769, 771, 340/805, 757, 784; 315/169.4, 169.1

[56] References Cited

U.S. PATENT DOCUMENTS 4,611,203 8/1986 Criscimagna et al. ..... 340/771
4,683,470 7/1987 Criscimagna et al. ..... 340/771
4,984,218 5/1990 Weber et al. ..... 315/169.6
5,030,888 7/1991 Salavin et al. ..... 340/805
5,059,963 10/1991 Fuknoka ..... 340/793

FOREIGN PATENT DOCUMENTS 2635901 3/1990 France .
2635902 3/1990 France .

*Primary Examiner*—Ulysses Weldon
*Assistant Examiner*—Doon Yue Chow
*Attorney, Agent, or Firm*—Oblon, Spivak, McClelland, Maier & Neustadt

[57] ABSTRACT

Disclosed is a method for the control of display screens that can be applied to internal memory type screens, notably plasma display panels for which it increases the dynamic range of the adjusting of the luminosity. This method consists in controlling the cells (C1 to C16) of the screen by means of addressing commands, each one of which comprises a selective command and a semi-selective command. According to one characteristic, for the addressing of one and the same line (L1 to L4) of cells (C1 to C16), the method consists in separating the selective command (CI) from the semi-selective command (CE) by an adjustable interval of time (PL1 to PL4).

6 Claims, 3 Drawing Sheets

METHOD FOR ADJUSTING THE LUMINOSITY OF DISPLAY SCREENS

BACKGROUND OF THE INVENTION

1. Field of the Invention

The invention relates to a method for the control of display screens, enabling an increase in the dynamic range of adjustment of the luminosity of these screens. The invention can be applied to internal memory type screens. By internal memory screens is meant screens wherein the cells that form the picture elements preserve the "written" state in which they are liable to be activated, after the end of the "written" state command signal as is the case, notably, with plasma display panels and, especially, ac plasma display panels.

2. Description of the Prior Art

The use of display screens in surroundings where the levels of luminosity are subject to very great variations may require the overall luminance of these screens to be adjusted according to the ambient luminosity in which they are used. In fact, it is recommended that the luminosity of the screen be comparable to that of the environment, without which the user will be subjected to unnecessary fatigue.

The lighting conditions around the screen may vary by a factor in the range of 1,000 (from some tens of lux in interior surroundings wit attenuated lighting to some tens of thousands of lux in external surroundings, as in bright sunlight).

This raises the problem of the dynamic range of adjustment of the overall luminance of these screens for, to date, this dynamic range is far smaller than that of the ambient luminosity, under the different possible conditions of use mentioned here above.

In the example of ac type plasma display panels, the standard method used to adjust the luminance of the screen consists in adjusting the frequency of signals, called sustaining signals, by which cells in the so-called "lit" or "written" state produce light.

The working and structure of ac type plasma display panels (which have a memory effect) are well-known per se. These panels are, for example, of the type having two electrodes in intersection to define a discharge cell, as described for example in a French patent, filed on behalf of THOMSON CSF and published under No. 2 417 848. These panels may also be of the coplanar sustaining type in which, for a single cell, addressing discharges and sustaining discharges are set up between different electrodes, as described notably in a European patent application No. EP-A-01035 382.

The principle and working of these ac type plasma display panels turns their property of memory to advantage in order to temporally separate the addressing functions (the writing or erasure of the information) of the cell from the functions used to produce the useful light.

These panels have a plurality of cells generally arranged in lines and columns. A given cell is addressed by the selection of two intersecting electrodes to which, at a given instant, appropriate voltages are applied so that the potential difference causes a writing discharge or an erasure discharge between these electrodes.

A standard addressing method uses a line-at-a-time operation. In this case, all the cells of a line are commanded simultaneously ("half-select" or semi-selective operation) to be "written on" or "erased", for example erased, and this operation is followed by a selective operation during which one or more selected cells of this same line are "written" on.

The semi-selective operation followed by the selective operation is accomplished for each line, with a time lag from one line to the next that corresponds to the duration of a line cycle.

It must be noted that the addressing by semi-selective and selective Operation is generally done by the superimposition of addressing square wave signals on basic square wave signals, as is explained for example in the French patent applications No. 88 11 247 filed on behalf of THOMSON CSF which should be considered as forming part of the present patent application, and in the French patent application No. 88 11 248 also filed on behalf of THOMSON-CSF.

These basic square wave signals are applied simultaneously to all the cells for a period of time that constitutes an addressing phase, and the addressing square wave signals are superimposed on these basic square wave signals only for the addressed lines with, from one line to another, the time lag corresponding to the duration of a line cycle CL. This means that the starting points of two consecutive addressing phases are separated by the duration of the line cycle.

Generally, in each line cycle, the addressing phase is followed by a sustaining phase during which the cells in the "written" state are activated, i.e. they produce light. Indeed, in the sustaining phase, sustaining signals are applied simultaneously to all the cells and prompt sustaining discharges that give the essential part of the emission of light perceived by the observer.

The sustaining signal is an ac signal constituted by voltage square waves that succeed one another with opposite polarities: each change in the sign of the ac signal (rising edge or trailing edge) causes a discharge in the gas and an emission of light at the cell or cells concerned. Thus, the quantity of light emitted by a cell in the "lit", i.e. "written" state is substantially proportional to the number of fronts corresponding to changes in polarity, and consequently to the frequency of the sustaining signal.

It must be noted that, in the addressing phase, the basic square waves, for the writing as well as for the erasure, have substantially the same amplitude as the sustaining signals and, consequently, they too may cause discharges comparable to the sustaining discharges, with light emission. Consequently, it may be considered that the addressing phases contain at least one sustaining cycle.

The frequency of the sustaining signal may be made adjustable and, when it is adjusted, the overall luminance of the screen is adjusted.

In practice, however, the information refreshing rates, namely the rates at which the image is renewed, as well as physical limits on the duration of the discharges, greatly restrict the possibilities of adjustment of the luminance of the screen by means of the variation in frequency of the sustaining signal.

For example, in the case of a standard plasma panel screen having 480 lines of cells, refreshed 50 times per second, i.e. with a frame period equal to 20 ms, the period of one line cycle CL corresponds to:

$$20\ \text{ms}/480 = 41.7\mu\text{s}.$$

In practice, about 20 μs are needed to carry out an addressing (during the addressing phase) that includes a half-select or semi-selective operation followed by a selective operation, and the time available within the line cycles for a phase specific to the sustaining cycles is equal to:

$$41.7\mu s - 20\mu s = 21.7\mu s.$$

FIGS. 1*a* and 1*b*, which should be looked at together, are graphs showing the distribution in time of these different phases, for only two consecutive lines Li and Li+1.

These two lines (but also all the 480 lines) simultaneously receive basic square waves (not shown) from an instant t0 onwards. These basic square waves form an addressing phase PA1. In the addressing phase, from the instant t0 to the instant t1, there is a period of erasure CE intended for command for erasure by a semi-selective operation followed, from the instant t1 onwards, by a writing period CI intended for a command for writing by a selective operation. The writing period CI ends at an instant t2 that also marks the end of the addressing phase PA1.

The addressing phase PA1 is followed by a sustaining phase PE1 that ends at an instant t3 when a second addressing phase PA2 starts. From the instant t0 onwards, the first addressing phase PA1 and the sustaining phase PE that follows defines a first line cycle CL1 that ends at the instant t3 when a second line cycle CL2 starts, and so on until a cycle CLn. All these line cycles CL1, CL2, CLn are set up in the same way.

Assuming that the addressing of the cells of the lines Li is done in a first line cycle CLl (during the first addressing phase PAl], the addressing of the line Li+1 is done during the second addressing phase PA2 of the second line cycle CL2. The addressing that follows for the line Li is then done 480 line cycles after the first cycle CLl, during the cycle CLn for example. In FIGS. 1*a*, 1*b*, the fact that the addressing has been done during a given addressing period is symbolized by hatched lines in the square waves that represent the addressing phases PA1, PA2, . . . PAn.

As mentioned further above, since the duration of an addressing phase PA1, PA2, PAn is 20 μs, in the case of the example chosen, this addressing phase may be followed by a sustaining phase PE1, PE2, PEn, the duration of which is equal at the maximum to 21.7 μs.

At least 5 μs are needed to achieve a cycle of sustaining signals, so that a sustaining phase may include 0 to 4 sustaining cycles (at the maximum), to which there is added a sustaining cycle contained in the addressing phase PA1, PA2.

Under these conditions, the mean sustaining frequency may be adjusted between substantially 24 KHZ (that is, 1+0 /41.7 μs) and 120 KHz (that is 1+4 / 41.7 μs).

The dynamic range of adjustment of the luminance that may thus be obtained by adjusting the frequency of the sustaining signals corresponds to a factor 5, and it is therefore fairly low. The dynamic range may be even further reduced for screens having a greater number of lines: indeed, when the total addressing time becomes equal to the frame period (which would be obtained with 1,000 lines in the example explained here above), any possibility of adjusting the luminance by this method is eliminated.

SUMMARY OF THE INVENTION

The method of the invention enables a great increase in the dynamic range of adjustment of the luminance of screens with memory, so that this dynamic range attains and even exceeds the dynamic range of variation of ambient luminosity in which these screens are to be used.

According to the invention, there is proposed a method for the control of a screen formed by cells arranged in n lines, wherein the "written" or "erased" state of the cells is set up by means of addressing commands each comprising two successive operations, one of the two operations being a selective command and the other operation being a semi-selective command, wherein, for at least one line, said method consists in separating the selective command from the semi-selective command by an interval of time during which the cells in the "written" state are activated.

Thus, if we assume that the screen is, for example, a 480-line plasma display panel in which there is applied a semi-selective erasure command, i.e. a command for the erasure of all the cells of a given line, and that, consequently, the selective operation is a writing command operation, it is possible to order the operation for writing on certain cells of a given line and to order their erasure at the end of a period of time (during which they are activated) adjustable between the duration of a line cycle multiplied by one and 480 times this duration, i.e. the frame period. This corresponds to adjusting the luminance of the panel since the activation of the cells is permitted only for an adjustable part of the frame period.

It is further seen that, unlike in the prior art, the method of the invention makes it possible to increase the dynamic range of adjustment when the number of lines increases.

BRIEF DESCRIPTION OF THE DRAWINGS

The invention shall be understood more clearly from the following description, given as a non-restrictive example and made with reference to the appended figures, of which.

DETAILED DESCRIPTION OF THE INVENTION

Figures 1A, 1B:
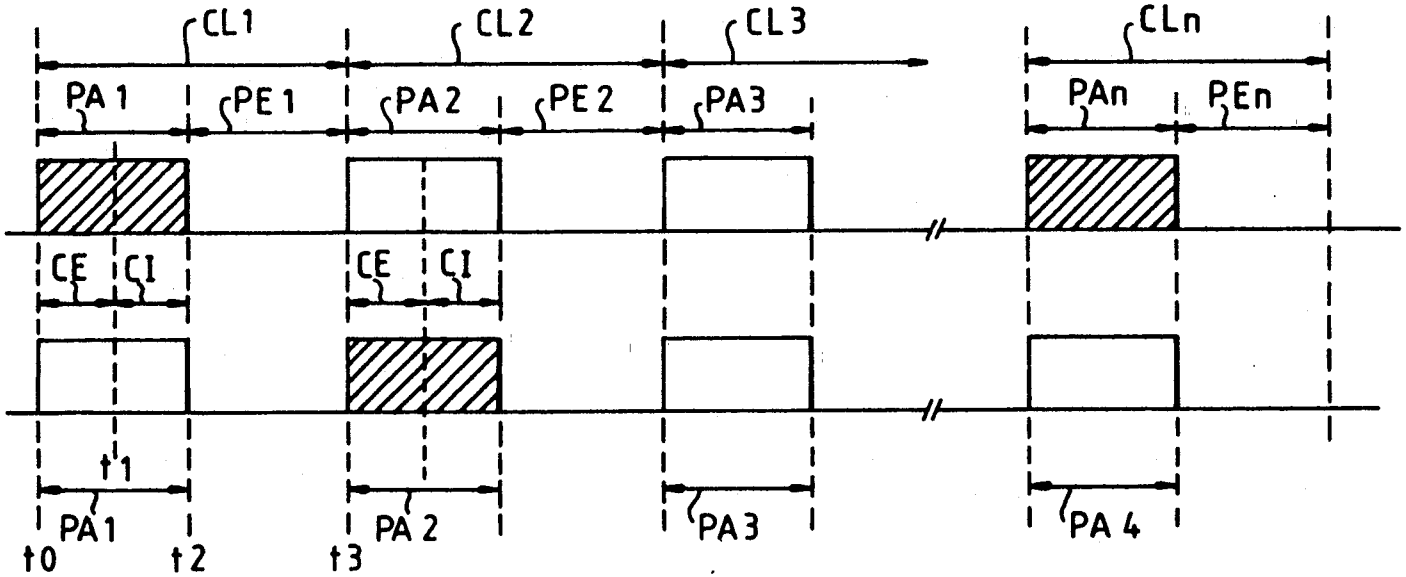
FIG.1a PRIOR ART
FIG.1b PRIOR ART
FIGS. 1*a* and 1*b*, already commented upon, illustrate the prior art.
Figure 2:
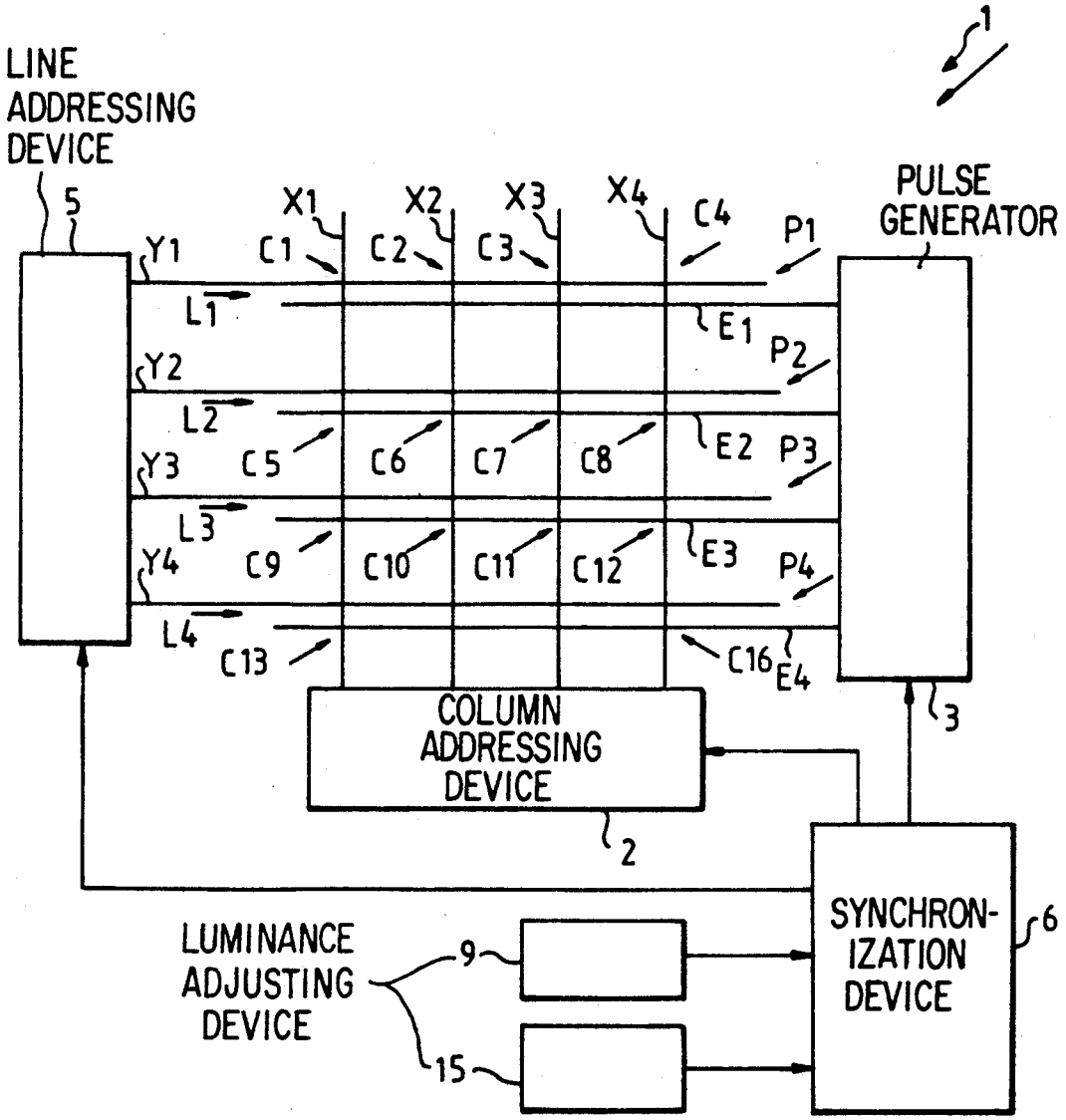
FIG. 2 shows a schematic view of a plasma display panel to which the invention may be applied.

FIG. 2 shows a schematic view, by way of a non-restrictive example, of an ac plasma display panel 1 to which the method of the invention may be applied.

The panel 1 is of the coplanar sustaining type. It includes column electrodes X1 to X4 that are orthogonal to pairs P1 to P4 of sustaining electrodes. Each intersection of a column electrode with a pair of electrodes Pl to P4 defines a cell Cl to C16 that represents a picture element. According to the non-restrictive example of the description, the figure shows only four column electrodes Xl to X4 and only four pairs Pl to P4 of electrodes that form four lines L1 to L4 of cells but it is clear that, within the framework of the invention, the panel 1 may include many more of these electrodes or eve fewer of them.

The column electrodes Xl to X4 have a purely addressing function. They are each connected in a standard way to a column addressing device 2.

Each of the pairs P1 to P4 of electrodes has an electrode known as an addressing-sustaining electrode, Y1 to Y4, and an electrode known as a purely sustaining electrode, E1 to E4.

The addressing-sustaining electrodes, Y1 to Y4, perform an addressing function in cooperation with the column electrodes, X1 to X4, and they perform a sustaining function in cooperation with the purely sustaining electrodes, E1 to E4, which have to perform this latter function only. The purely sustaining electrodes, E1 to E4, are connected to one another and to a pulse generator 3 from which they all simultaneously receive cyclical square waves of voltage so that sustaining cycles may be established.

The addressing-sustaining electrodes are electrically separated into individual units and are connected to a line addressing device 5 from which they receive notably the following types of voltage square waves (not shown):

cyclical voltage square waves in synchronism with those applied to the purely sustaining electrodes, E1 to E4, for example during a sustaining phase PE as mentioned here above for the prior art, during an addressing phase, basic square waves as mentioned here above in the introduction, on which there may be superimposed (solely for the addressed lines) addressing signals to command the operations of erasing and writing on the cells. These square waves are delivered in synchronism with signals applied to the column electrodes X1 to X4.

Figure 3:
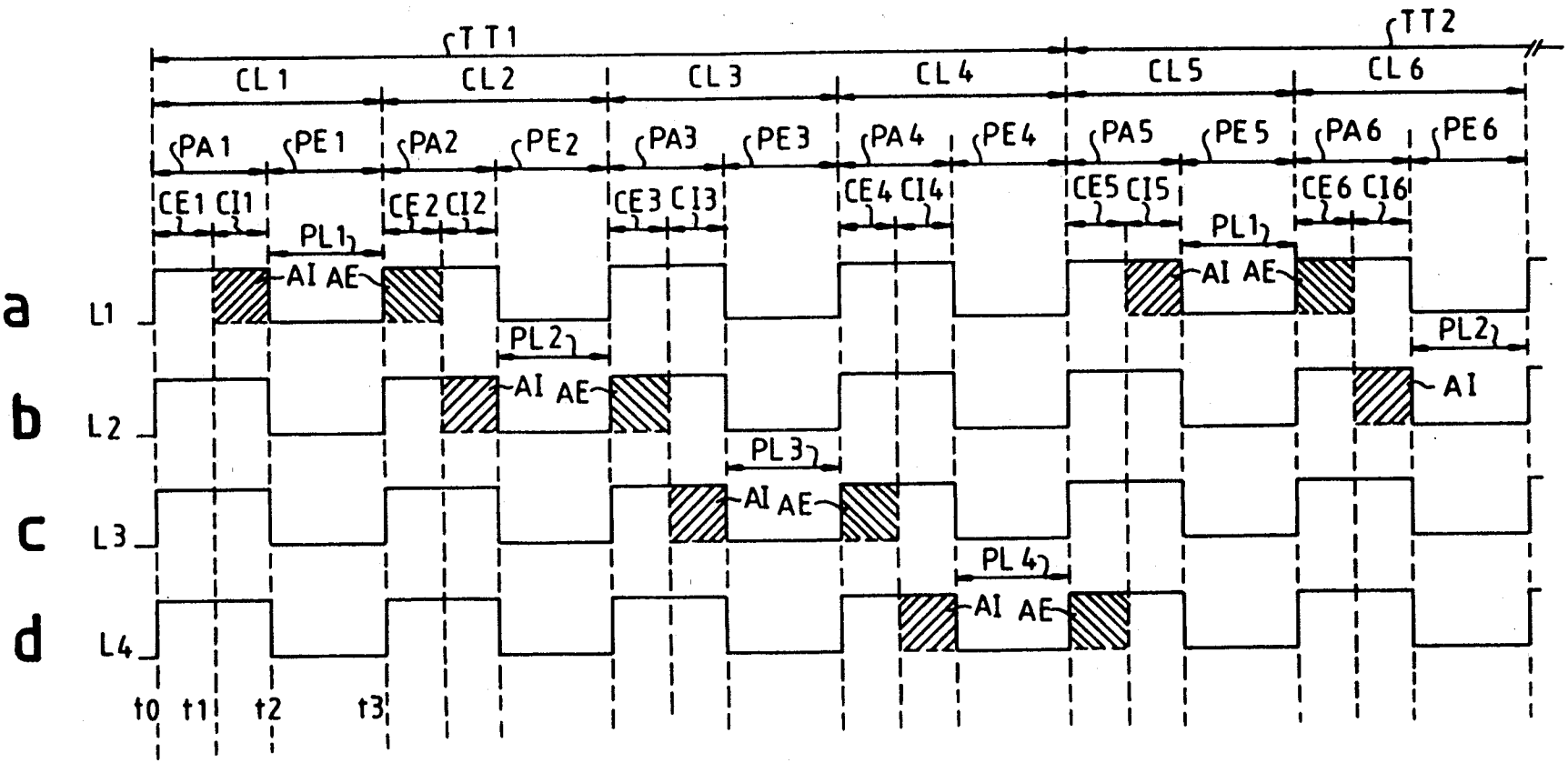
FIG. 3 (*a* to *d*) illustrates the application of the method of the invention to the plasma display panel shown in FIG. 2.

The synchronization between the cells applied to the different electrodes is symbolized in FIG. 3 by the presence of a control and synchronization device 6 that is connected to the two addressing devices 2, 5 and to the generator 3.

As the case may be, the panel 1 may further include a means to control the frequency of the sustaining cycles, as already mentioned here above for the prior art. Since this means constitutes a device 9 for adjusting the luminance of the panel, it is connected to the control and synchronization device 6.

FIG. 3 (*a* to *d*) shows graphs that illustrate the working of the panel 1 under the control of the method according to the invention. FIG. 3*a* illustrates the working of the first line L1. FIG. 3*b* illustrates the working of the second line L2. FIGS. 3*c* and 3*d* respectively relate to the third line and the fourth line L3, L4.

From the instant tO onwards, and simultaneously for all the lines L1 to L4, the voltage square waves (not shown) applied to the electrodes determine a succession of n addressing phases PA1, PA2, . . . , PAn separated by a sustaining phase PE1 to PE6 (n being equal to 6 in the non-restrictive example described). Each addressing phase plus a sustaining phase constitutes a line cycle CL1 to CL6. Each addressing phase PA1 to PA6 includes, in a standard way, a period of semi-selective operation, CE1 to CE6, for erasure for example, followed by a period of selective writing command operation CI1 to CI6.

According to one characteristic of the invention, the erasing and writing operations for each of lines L1 to L4 are separated in time, that is, they are carried out in different addressing phases PA1 to PA6 belonging to different line cycles.

For the first line L1, it is assumed that a semi-selective erasure command has already occurred in a cycle that precedes t0, in such a way that, during the first addressing phase PA1 (which starts at the instant t0), only a selective writing operation is done. The first erasure period CE1 starts at the instant t0 and ends at an instant t1 and, in the non-restrictive example described, no addressing is done during this period.

The instant t1 is the starting instant of a first writing period CI1 during which a first writing command AI is effectively applied. This is a command for the operation of writing on the cells belonging to the first line L1 (a writing command that has been actually carried out is represented in FIG. 3 (*a* to *b*) by the fact that the part of the square wave symbolizing the corresponding writing period is hatched).

The instant t2 is the start of a first sustaining phase PE1 that lasts up to an instant t3 when a second addressing phase PA2 starts. The time that has elapsed between the instant t0 and the instant t3 corresponds to the duration of the first line cycle CL1, the second addressing phase PA2 starts with a second line cycle CL2.

Assuming that sustaining cycles are applied to the cells during the sustaining period PE1, the cells of the first line L1 produce light at each sustaining cycle and do so for as long as they are in the written state. In the prior art, the erasure of the first line L1 by semi-selective operation takes place after a period that corresponds to the frame period, i.e. to the period of a line cycle multiplied by the number of lines or, in other words, this semi-selective erasure occurs just before the writing operation and in the same addressing phase as this writing operation. In the non-restrictive example described, where the plasma panel includes four lines L1 to L4, if the erasure of the first line L1 were to be done as in the prior art, it would take place at the end of four line cycles, i.e. in a fifth addressing phase PA5.

With the method of the invention, this erasure may occur earlier: for example, it may be done in the addressing phase that follows the one in which the writing is done, or in a different following addressing phase.

In the non-restrictive example described, the semi-selective erasure command is carried out during the addressing phase that follows the one in which the writing has been done.

For example, for the first line L1, a semi-selective erasure command AE is applied during the second erasure period CE2 of the second addressing phase PA2 and then during the sixth erasure period CE6 contained in the sixth addressing phase PA6. A writing command AI has been carried out beforehand during the fifth writing period CI5 of the fifth addressing phase PA5 (an erasing command that has been actually carried out is represented in FIG. 3 by the fact that the part of the signal wave that symbolizes the corresponding erasure period is hatched in a direction opposite to that of the hatched portions representing a writing command).

For the second line L2, the selective writing AI takes place during the second writing period CI2, and the semi-selective erasure AE takes place during the third erasure period CE3. For the third line L3, the selective writing AI is done during a third writing period CI3 and the semi-selective erasure AE is done during the fourth erasure period CE4. For the fourth line L4, the selective writing AI is done in the fourth writing period CI4 and the erasure AE is done during the fifth erasure period CE5.

The fifth erasure period CE5 marks the start of a fifth line cycle CL5, and marks the start of a second frame period for the first line L1. Since the erasure of the first line L1 has been done during the second erasure period CE2, this operation does not have to be done in this new frame period before the selective writing command is applied. This selective writing command is carried out during a fifth writing period CI5. A same type of functioning as earlier is repeated in this new frame period for the other lines L2, L3, L4.

Thus, the semi-selective operation has, firstly, the function of erasing all the cells of a line to prepare their writing if necessary and, secondly, the function of extinguishing the lit cells, i.e. the cells that are written on, so as to adjust their luminance by adjusting the duration of a luminance phase PL1, PL2, PL3, PL4 where they are in the written state. This luminance phase corresponds to the period between the first writing period CI1 and the second erasure period CE2, between the second writing period CI2 and the third erasure period CE3 etc.

The quantity of light emitted by each of the cells of the lines L1 to L4 is thus proportional to the duration of the luminance phase PL.

In the non-restrictive example shown in FIG. 3 (*a* to *d*), the duration of the luminance phase PL is the minimum duration. It corresponds to the period of time between two consecutive addressing phases PA1, PA2, but the luminance phase may have a greater duration that may go up to that of a frame period. Indeed if it is assumed, to simplify the explanation, that a luminance phase PL corresponds to the duration of a line cycle CL1, CL2, . . . , CL6, the luminance phase PL may have a duration equal to N×tCL where N is a whole number smaller than the number n of lines and tCL is the duration of one line cycle CL1, CL2, CL3.

This corresponds to choosing the number of line cycles (each line cycle being defined, for example, from one addressing phase to a following addressing phase) during which the cells of each line remain lit (i.e. are activated) in indexing the semi-selective addressing of a given line L1 to L4 to the addressing phase for another line. An adjusting operation such as this can be done very finely, for N (while it is a whole number) may have several hundreds of values ranging between 1 and the total number of lines n which, for its part, is usually greater than 500. With 1,000 lines, for example, the overall luminance may vary by a factor of 1,000, namely three decades.

Thus, several different types of sequencing may be programmed and, to obtain the desired luminance adjustment, it is enough to choose the corresponding sequencing by using digital encoding means for example, or other means such as, notably, switches, encoding wheels etc. These means are placed at the disposal of the user on a second adjusting device 15 (shown in FIG. 2) connected, for example, to the synchronization and control device 6.

This method may also be combined with the adjusting of the mean sustaining frequency, so that an even greater dynamic range is obtained.

It must be noted that the description has been made with reference to addressing of the type comprising a semi-selective operation for erasure followed by a selective operation for writing but it is clear that the invention is applicable substantially in the same way if the semi-selective operation is used for writing and if the selective operation is used for erasure. These examples of use could notably lead to modification of the contrast.

In the non-restrictive example shown in FIG. 3 (*a* to *d*), the luminance phase PL1 to PL4 have the same duration for all four lines L1 to L4 but it is clear that the method of the invention can also be used in such a way that the luminance phases of the different lines are given durations, some of which differ from one another, or all of which differ from one another.

For example, the erasing and writing operations can be carried out, as in the prior art, for all the lines except for one line (or one group of lines) for which these operations may be performed according to the method of the invention, in such a way that this line will appear with a lower luminance than the rest of the screen.

It is also possible to adopt the opposite approach and make this line (or group of lines) brighter than the rest of the screen by acting, as stated further above, for all the lines of the screen except for the one that appears brighter, and for this line the erasing and writing operations could be carried out, for example, during same addressing phases to give it a maximum luminance.

The method of the invention can be applied to all screens having an internal memory. This is the case with ac plasma display panels, whether with coplanar sustaining or not. However, it is also the case with certain dc type plasma display panels, notably those disclosed in IEEE Trans. El. Dev., Vol. 36, No. 6, June 1989, pp. 1036–1072. This is also the case with certain electroluminescent screens and also with liquid crystal display screens.

With respect to liquid crystals display screens, it is true that these screens are different from those referred to above inasmuch as they do not produce light themselves but work in a transmission mode and modulate the light of a light source before which they are placed.

However, the method may be applied to liquid crystal display screens inasmuch as they enable the duration of transmission of light to be adjusted in order to adjust the luminance, specially in active matrix type liquid crystal display screens wherein each cell incorporate a switching element that is often formed by a transistor called a TFT (thin-film transistor). The structure of a liquid crystal display screen with active matrix is shown and described notably in the journal *IEEE Spectrum*, Sept. 1989 pp. 36–40.

In a liquid crystal display screen such as this, the TFT is in the "conductive " or "non-conductive" state depending on the command applied to it. When it is conductive, it lets through a signal towards the liquid crystal cell which behaves like a capacitor. Since the capacitor is charged, the signal may disappear without there being any substantial modification of the cell (i.e. of the electrical field established) if the TFT has returned, beforehand, to the non-conductive state. In this case, the cell exhibits a memory effect.

Given the type of liquid crystal and the type of polarizer used:

A. if the liquid crystal cell is "opaque" at rest (with no applied electric field), the erasure should occur in a semi-selective way (with the erasure of all the cells of a given line), and it is the writing that has to be done selectively;

B. if, on the contrary, the liquid crystal is "on" at rest, it is the writing that has to be semi-selective and the erasure that has to be selective; the "opaque" state corresponds to the "erased" state mentioned above, and the "on" state corresponds to the "written" state.

In the example A for example, mentioned here above, the erasure may consist in repositioning the cell in the "opaque" state by activating the conduction of the TFT.

What is claimed is:

1. A method for controlling an illumination intensity on n cell lines of a display screen, each of said n cell lines being divided into a predetermined number of frame periods, said frame periods being further divided into a plurality of line cycles having a time period, said line cycles each comprising an equal number of addressing phase periods and sustaining phase periods, wherein each of said addressing phase periods consists of a selective command period and a semi-selective command period, said method comprising the steps of:

a) applying a voltage square wave to a selected one of said n cell lines;

b) performing one of a writing operation and an erasing operation during said selective command period of a first line cycle of said selected cell line;

c) performing the other of said writing operation and erasing operation during said semi-selective command period of a second line cycle of said selected cell line;

d) renewing, line by line, an image displayed on said display screen according to a frame period which corresponds to the product of the number of cell lines n by the time period of said line cycles, wherein steps b) and c) are separated by an adjustable interval of time, the minimum duration of which is smaller than the time period of one of said line cycles and wherein said adjustable interval of time can be adjusted in increments equal to the time period of a line cycle.

2. A method according to claim 1 wherein, between at least two cell lines, different durations are set for the interval of time between a semi-selective command and a selective command.

3. A method according to claim 1, wherein a semi-selective command is separated from a selective command for the commanding of all the lines.

4. A method according to claim 1, wherein the display screen is a plasma display panel.

5. A method according to any one of claims 4, and 1, wherein the display screen is an ac plasma display panel, and wherein at least one cycle of square waves is applied to all the cells between a selective command and a semi-selective command.

6. A method according to claim 1, wherein the display screen is an active matrix type liquid crystal display screen.

* * * * *